US005495919A

United States Patent [19]

Ericson et al.

[11] Patent Number: 5,495,919

[45] Date of Patent: Mar. 5, 1996

[54] SAFETY BRAKE APPARATUS FOR AN ELEVATOR CAR OR COUNTERWEIGHT

[75] Inventors: Richard J. Ericson, Southington; James M. Draper, Woodstock, both of Conn.

[73] Assignee: Otis Elevator Company, Farmington, Conn.

[21] Appl. No.: 232,566

[22] Filed: Apr. 25, 1994

[51] Int. Cl.[6] ..... B66B 5/04

[52] U.S. Cl. ..... 187/373; 187/375

[58] Field of Search ..... 187/373, 375, 187/376, 374, 350; 188/188, 189

[56] References Cited

U.S. PATENT DOCUMENTS

| | | | |
|---|---|---|---|
| 1,803,762 | 5/1931 | Marks | 187/89 |
| 2,150,373 | 3/1939 | Hymans | 187/90 |
| 2,493,553 | 1/1950 | Sahlin | 187/87 |
| 2,586,217 | 2/1952 | Gagnan | 187/87 |
| 3,441,107 | 4/1969 | Thorne et al. | 187/90 |
| 4,083,432 | 4/1978 | Lusti | 187/373 |
| 4,538,706 | 9/1985 | Koppensteiner | 187/90 |
| 4,565,264 | 1/1986 | Kunil | 187/373 |
| 5,002,158 | 3/1991 | Ericson et al. | 187/39 |
| 5,065,845 | 11/1991 | Pearson | 187/89 |
| 5,096,020 | 3/1992 | Korhonen | 187/88 |
| 5,230,406 | 7/1993 | Poon | 187/376 |
| 5,377,786 | 1/1995 | Nakagawa | 187/373 |

FOREIGN PATENT DOCUMENTS 495475 4/1930 Germany .

OTHER PUBLICATIONS

Jones "Ingenious Mechanisms for Designers and Inventors" 1936, The Industrial Press, New York, pp. 407–408.

*Primary Examiner*—Kenneth Noland

[57] ABSTRACT

A safety brake apparatus for a vehicle traveling in an elevator hoistway is provided, comprising a first link, a pair of second links, a connector rod, and an intermediate link. The first link is pivotly attached to a first side member of the vehicle. The connecting rod extends through the first and second side members, pivotly mounted within each side member. One of the second links is fixed to the connecting rod on the first side member side of the vehicle and the other second link is fixed to the connecting rod on the second side member side of the vehicle. The intermediate link is pivotly attached to both the first and second links on the first side member side of the counterweight. Each second link is connected to a safety brake. Actuating the first link causes the intermediate link to rotate the second links and therefore the connector rod, and causes the second links to actuate the respective safety brake.

23 Claims, 5 Drawing Sheets

SAFETY BRAKE APPARATUS FOR AN ELEVATOR CAR OR COUNTERWEIGHT

BACKGROUND OF THE INVENTION

1. Technical Field

This invention relates to elevators in general, and to elevator safety brake apparatus in particular.

2. Background Information

Safety regulations concerning the operation of elevators require a safety brake on the elevator car and sometimes on the counterweight of the elevator to stop the elevator in the event of a gross overspeed condition. Typically, the overspeed condition is detected by a governor rope assembly comprising a governor sheave, a governor rope, a centrifugally actuated governor rope brake, and a tension sheave. The governor rope is formed in a closed loop extending between the governor sheave at the top of the hoistway and the tension sheave at the bottom of the hoistway. A linkage, consisting of a rod or a cable pigtail, for example, connects the governor rope to a safety apparatus aboard the vehicle for actuating the safety brakes.

In normal operation, the linkage pulls the governor rope along at the same speed as the vehicle. In the event of a downward overspeed condition, the centrifugally actuated governor rope brake applies a brake force to the governor rope, and thereby causes the governor rope to travel at a slower speed than the vehicle. As a result, the linkage extending between the rope and the safety apparatus actuates the apparatus and therefore the safety brakes as well. The safety brakes progressively stop the vehicle by applying a frictional force to the guiderails guiding the vehicle.

One of the more popular safety brakes, also known as a progressive safety, is that disclosed by Koppensteiner in U.S. Pat. No. 4,538,706, which is hereby incorporated by reference thereto. Koppensteiner discloses a safety brake which straddles an elevator rail and is attached to the frame of the vehicle. The safety brake employs a brake surface on one side of the rail and a leaf spring and roller assembly on the opposite side. When the elevator governor activates the safety, an actuating rod causes the roller to wedge between the leaf-spring assembly and a rail face. As a result, the brake lining located on the opposite side of the rail contacts the opposite rail face, producing a braking force on the elevator car.

Safety brakes are generally attached directly to the frame of the car or the counterweight by conventional fasteners. The large load applied to the safety brake in an emergency stop is transferred to the frame of the vehicle by one or more tongues extending out from the back of the brake and into slots within the vehicle frame. While advantageous for transferring the load, these tongues make it impossible to remove the safety while the vehicle is positioned between the guiderails. Specifically, the distance between the guiderails less the assembled width of the vehicle and safety brakes is not great enough to allow the tongue(s) to be withdrawn completely from the frame. As a result, one of the guiderails must be removed before the safety and/or the vehicle can be removed. A person of skill in the art will recognize that removing a guiderail is an arduous job and therefore a distinct disadvantage.

Safety apparatus aboard an elevator car or counterweight for actuating the safety brakes is known in the art. U.S. Pat. No. 4,083,432 to Lusti discloses a safety apparatus for use with a centrifugally operated governor. The apparatus includes a compensating means to prevent the inertial force of a flexible governor member from operating the safety brakes. U.S. Pat. No. 5,230,406 to Poon discloses a safety brake arrangement for preventing overspeeding in the upward and downward direction.

A person of skill in the art will recognize that it is an advantage to minimize the complexity of an elevator safety arrangement and also to increase the reliability of the safety arrangement. A person of skill in the art will further recognize that is an advantage to decrease the amount of time necessary to actuate the safeties, since the speed of the vehicle accelerates by virtue of gravity.

SUMMARY OF THE INVENTION

It is, therefore, an object of the invention to minimize the actuation time of a safety brake.

It is a further object of the present invention to minimize the required space for safety brakes and attached linkage.

It is a still further object of the present invention to increase the reliability of a safety brake apparatus.

It is a still further object of the present invention to minimize the necessary maintenance of a safety brake apparatus.

It is a still further object of the present invention to prevent the safety brakes from actuating in response to inertia of the governor rope.

It is a still further object of the present invention to facilitate the removal of a safety from a car or counterweight frame.

It is a still further object of the present invention to facilitate the installation of a vehicle within, or the removal of the vehicle from the hoistway.

According to the present invention, a safety brake apparatus for a vehicle traveling in an elevator hoistway is provided, comprising a first link, a pair of second links, a connector rod, and an intermediate link. The first link is pivotly attached to a first side member of the vehicle. The connecting rod extends through the first and second side members, pivotly mounted within each side member. One of the second links is fixed to the connecting rod on the first side member side of the vehicle and the other second link is fixed to the connecting rod on the second side member side of the vehicle. The intermediate link is pivotly attached to both the first and second links on the first side member side of the counterweight. Each second link is connected to a safety brake. Actuating the first link causes the intermediate link to rotate the second links and therefore the connector rod, and causes the second links to actuate the respective safety brake.

According to one aspect of the present invention, an inertia compensator is provided. The inertia compensator dissipates the inertia of a governor rope connected to the first link when the vehicle accelerates, and thereby prevents the safety brakes from actuating in response to the inertia of the governor.

According to another aspect of the invention, the safety brake apparatus is mounted on a vehicle having a frame with a first side and a second side and a pair of removably attached frame extensions. The safety brakes are attached to the frame extensions.

An advantage of the present invention is that the amount of time necessary to actuate the safety brakes is minimized. A person of skill in the art will recognize that it is a distinct advantage to actuate the safeties as quickly as possible in an overspeed situation because the vehicle is often accelerating. The acceleration may be caused by gravity or by a power on drive fault. The speed of the vehicle is directly related to the amount of energy to be dissipated by the safety brakes, and therefore also the potential for damage to the elevator equipment.

Another advantage of the present invention is that it minimizes the required space for safety brakes and attached linkage. A person of skill in the art will recognize that it is an advantage to minimize the amount of space required within the hoistway. It is known that safety apparatus may be mounted to a side of a vehicle outside of the guiderails and/or across the top of the vehicle in the crosshead area. These mounting arrangements increase the width and/or the length of the vehicle and therefore the required space within the hoistway. The present invention, on the contrary, may be mounted along the sides of the vehicle, between the guiderails. The present invention obviates the need for a linkage extending across the vehicle in the crosshead area, thereby leaving the crosshead area free for roping apparatus.

Still another advantage of the present invention is that the present invention increases the reliability of a safety brake apparatus by minimizing the complexity of the linkages. It is known in the art that a safety brake apparatus may comprise a first, second and third linkage. The first linkage consists of rods and cranks extending across the vehicle in the crosshead area. The second and third linkages extend from the first linkage in the crosshead area down to the safety brakes on each side of the vehicle. The present invention, in comparison, provides a similarly functioning apparatus with fewer pieces in a much smaller area.

Still another advantage of the present invention is that the simplicity of the present invention minimizes the necessary maintenance of the safety brake apparatus.

Still another advantage of the present invention is the increased reliability and ease of use of the inertia compensator. A person of skill in the art will recognize that the safety brake apparatus known in the art necessitated the use of rather complex inertia compensators and that it is a distinct advantage to provide a simple and more reliable inertia compensator.

Still another advantage of the present invention is that the frame extensions of the present invention facilitate the removal of the safeties from a car or counterweight frame. Moreover, the frame extensions also facilitate the installation or removal of the vehicle in the hoistway.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
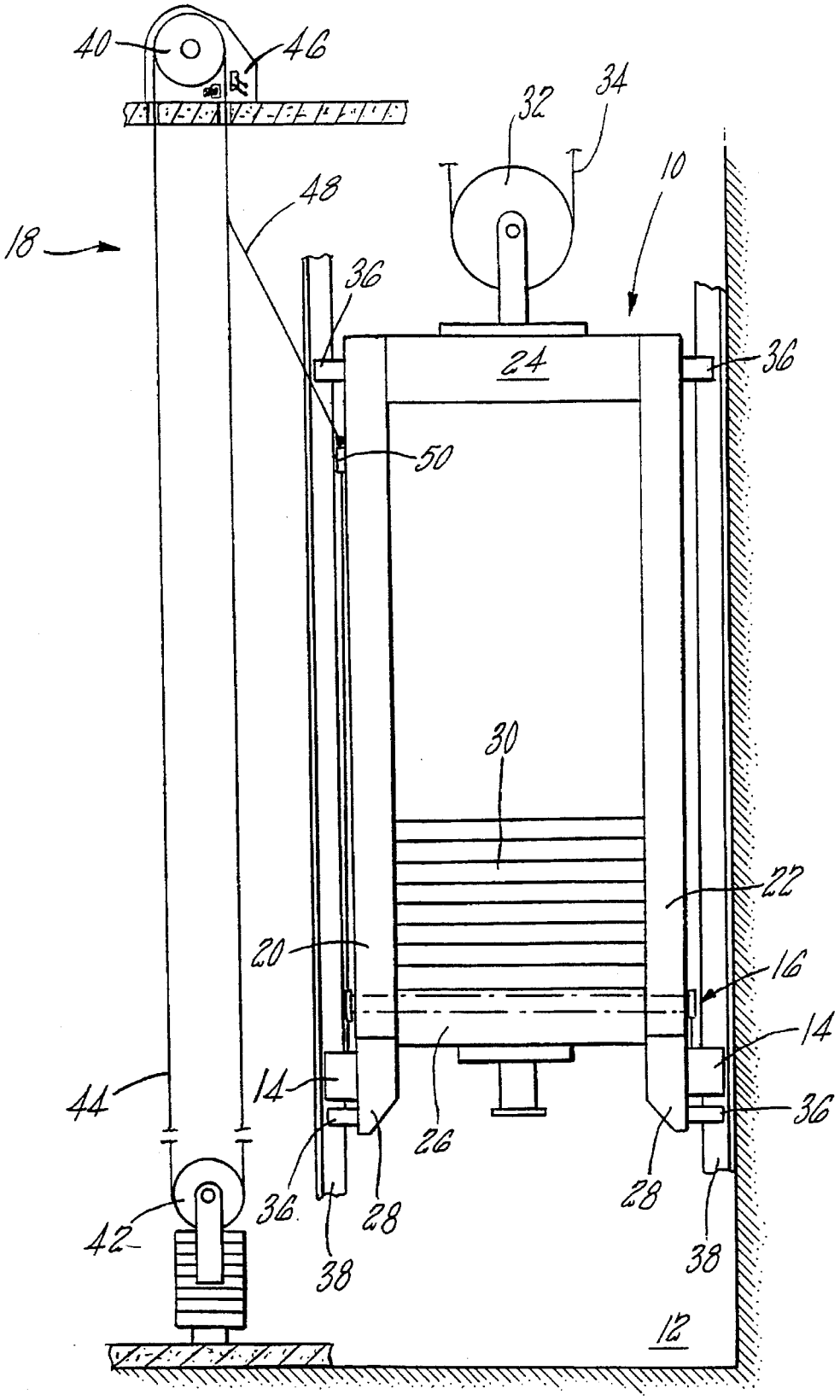
FIG. 1 is a diagrammatic view of an elevator, specifically showing the counterweight and the governor arrangement.
Figure 2:
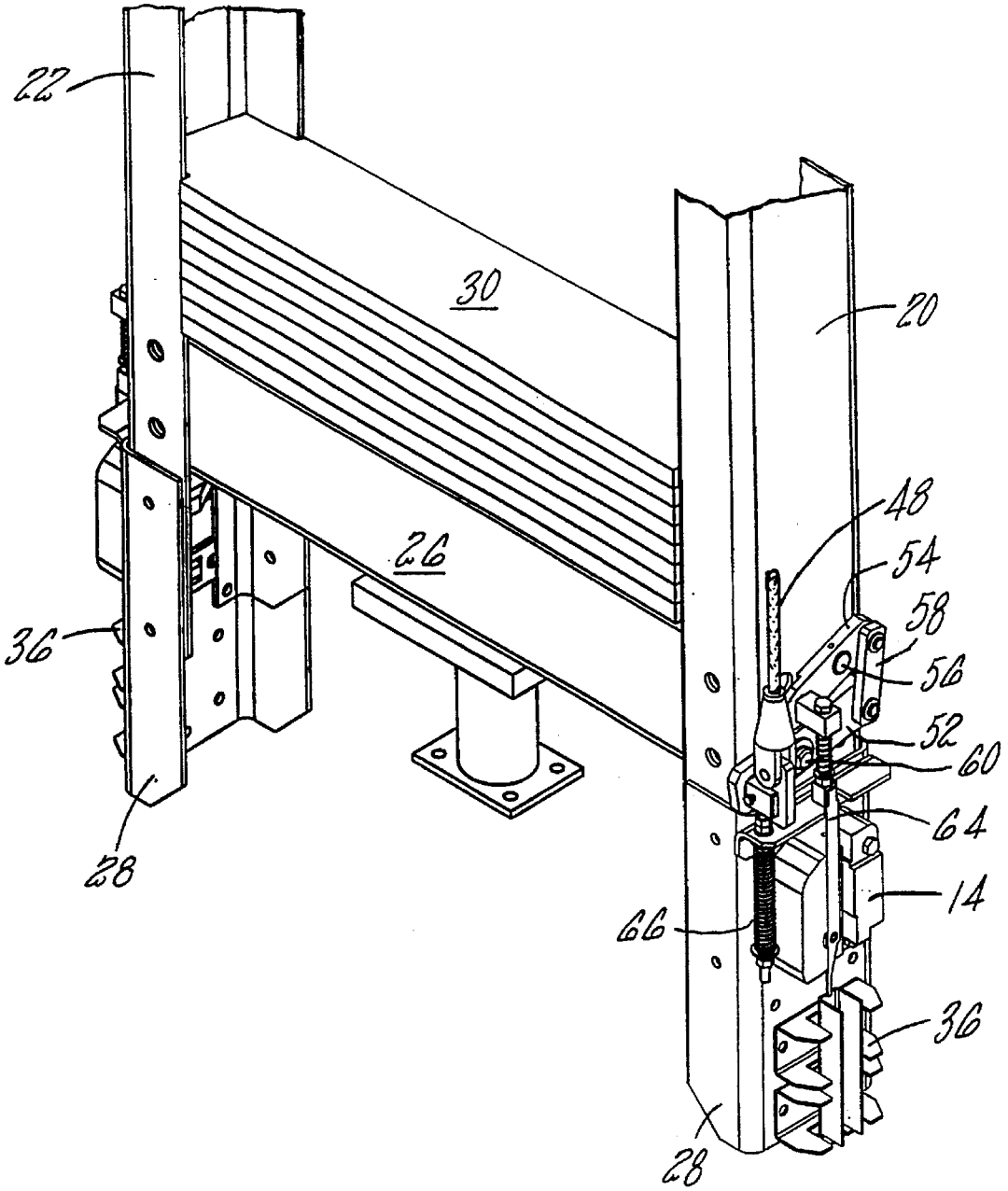
FIG. 2 is an isometric partial view of the counterweight having the safety apparatus and safeties mounted thereon.
Figure 3:
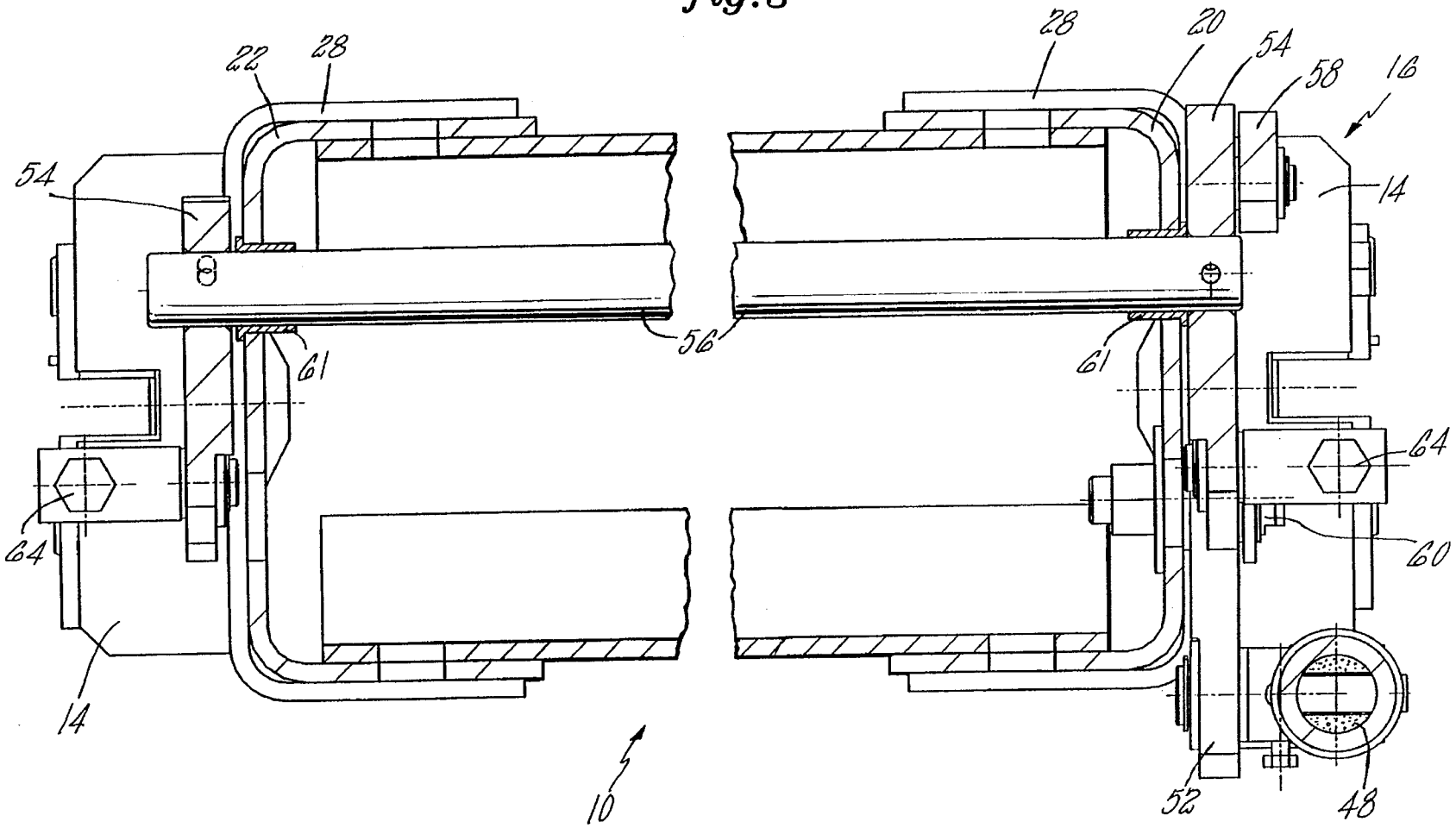
FIG. 3 is a cross-sectional view of the counterweight showing the safety apparatus.

Referring to FIG. 1, an elevator counterweight 10 is simplistically shown in a hoistway 12 having a safety arrangement which includes a pair of safety brakes 14, a safety brake apparatus 16, and a governor assembly 18. The counterweight 10 includes a frame, consisting of a first 20 and second 22 frame member extending between a crosshead 24 and a safety plank 26, a pair of frame extensions 28, and a plurality of weights 30. One frame extension 28 is attached to each frame member 20,22 by conventional fasteners. A 2:1 counterweight roping sheave 32 is shown attached to the crosshead 24, although other roping schemes may be used alternatively. Ropes 34 extending up from the counterweight sheave 32 connect the counterweight 10 to the elevator car (not shown). Guides 36 attached to both frame members 20,22 cooperate with a pair of guiderails 38 to guide the counterweight 10 as it travels through the hoistway 12.

The governor assembly 18 comprises a governor sheave 40, a tension sheave 42, a governor rope 44, and a centrifugally actuated rope brake 46 as is known in the art. The governor rope 44 is formed in a closed loop that extends the length of the hoistway 12, wrapping around the governor sheave 40 at the top of the hoistway 12 and around the tension sheave 42 at the bottom of the hoistway 12. A rope pigtail 48 connects the governor rope 44 to the safety brake apparatus 16 mounted on the counterweight 10. The rope pigtail 48 extends from the governor rope 44, through an alignment bracket 50 mounted on the first frame member 20, and down to the safety brake apparatus 16. Other types of linkages may be used alternatively to connect the safety brake apparatus 16 to the governor rope 44.

Referring to FIGS. 2–5, the safety brake apparatus 16 includes a first link 52, a pair of second links 54, a connector rod 56, and an intermediate link 58. The first link 52 is pivotly attached to the first frame member 20 by a pin and clip combination 60. The pigtail 48 pivotly attaches to one end of the first link 52. The pivot attachment helps prevent the pigtail 48 from binding as the first link 52 pivots about the pin 60. The connecting rod 56 extends through the first 20 and second 22 frame members, pivotly mounted within a sleeve bearing 61 (see FIG. 3 ) in each frame member 20,22. One of the second links 54 is fixed to the connecting rod 56 on the first frame member 20 side (see FIG. 4) of the counterweight 10 and the other second link 54 is fixed to the connecting rod 56 on the second frame member 22 side (see FIG. 5) of the counterweight 10. The intermediate link 58 is pivotly attached to both the first 52 and second links 54 on the first frame member 20 side of the counterweight 10, as is shown in FIGS, 2 and 4.

A safety brake 14 similar to that taught by Koppensteiner in U.S. Pat. No. 4,538,706 is mounted to the frame extension 28 on each side of the counterweight 10. The safety brake 14 includes an actuating rod 64 extending outwardly from the brake 62, which is attached to the second link 54 on the respective side of the counterweight 10. A person of skill in the art will recognize that other safety brakes are known in the art and may be used alternatively.

Figure 4:
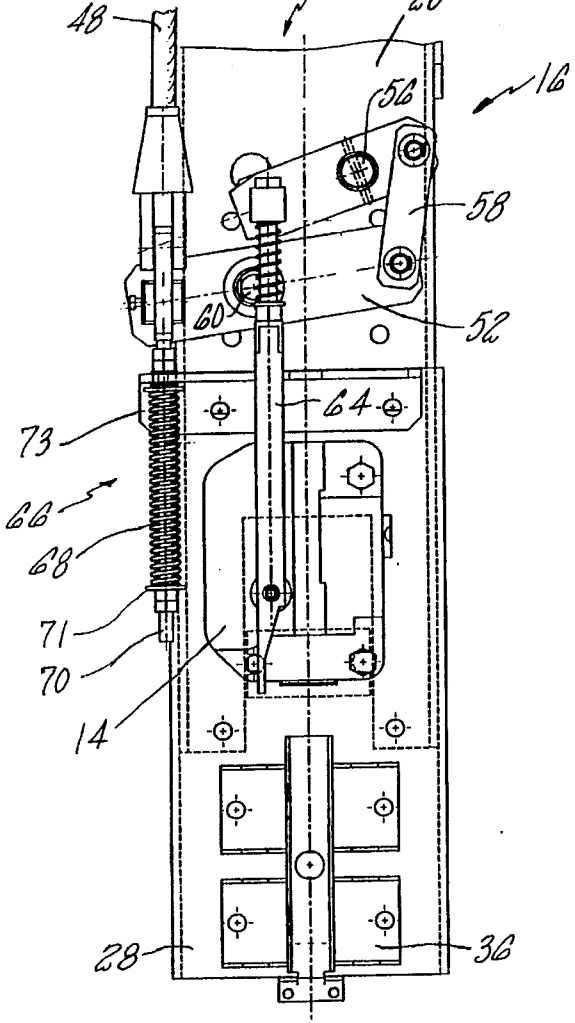
FIG. 4 is a side view of the safety brake apparatus on a first frame member.

Referring to FIG. 4, an inertia compensator 66 is provided attached to the frame extension 28. The inertia compensator 66 comprises a spring 68 and rod 70 assembly connected to the first link 52 which biases the first link 52 in the direction opposite the pigtail 48. The spring 68 acts between a washer 71 attached to the rod 70 and a bracket 73 attached to the frame extension 28.

Referring to FIG. 1, in the operation of an elevator under normal conditions, the governor rope 44 of a governor assembly 18 will be drawn along at the same speed as the counterweight 10 to which it is attached. More specifically, the mass of the rope 44 and friction within the governor assembly 18 will initially cause the rope 44 to resist the motion of the counterweight 10. The initial resistance of the governor assembly 18 to the acceleration of the counterweight 10 may be referred to generally as the inertia of the governor assembly 18. As the counterweight's acceleration decreases and approaches a constant velocity,, the inertia of the governor assembly 18 dissipates and the normal drag of the governor assembly 18 remains.

Referring to FIG. 4, the inertia compensator 66 attached to the first link 52 prevents the safety brake apparatus 16 from actuating the safety brakes 14 in response to the inertia of the governor assembly 18 by resisting motion of the first link 52. More specifically, any force applied to the first link 52 through the pigtail 48 is opposed by spring 68 of the inertia compensator 66. A person of skill in the art will recognize that as the amount of rope 44 in a governor assembly 18 (see FIG. 1) increases, so does the inertia of that governor assembly 18. The characteristics of the spring 68 are, therefore, chosen to accommodate whatever inertial forces may be present in the governor assembly 18 of a particular elevator system. Indeed, the inertia compensator 66 is adjustable and may be used with a variety of different elevators.

In the event of an downward overspeed condition, the centrifugally actuated governor brake 46 shown in FIG. 1 applies a brake force to the governor rope 44. As a result, the speed of the rope 44 decreases relative to the overspeeding counterweight 10, and thereby draws upwardly on the pigtail 48 attached to the safety brake apparatus 16. The force transmitted through the pigtail 48 is great enough to overcome the resistance of the inertia compensator 66. The pigtail 48 causes the first link 52 to pivot about the pin 60, and therefore also causes the intermediate link 58 to pivot the second links 54 and connecting rod 56. The pivoting second links 54 in turn pull upwardly on the actuating rods 64 of the safety brakes 14, and thereby actuate the safety brakes 14.

An advantage of the safety brake apparatus 16 is that it can be arranged to expedite the actuation of the safety brakes 14 relative to the motion of the pigtail 48 and governor rope 44. A person of skill in the art will recognize that gravity accelerates all objects free falling toward the earth at a rate of 32.2 ft/sec$^2$ (9.81 m/s$^2$). It is a decided advantage, therefore, to stop the elevator car or counterweight 10 as quickly as possible to minimize the energy to be dissipated by the safeties.

Figure 5:
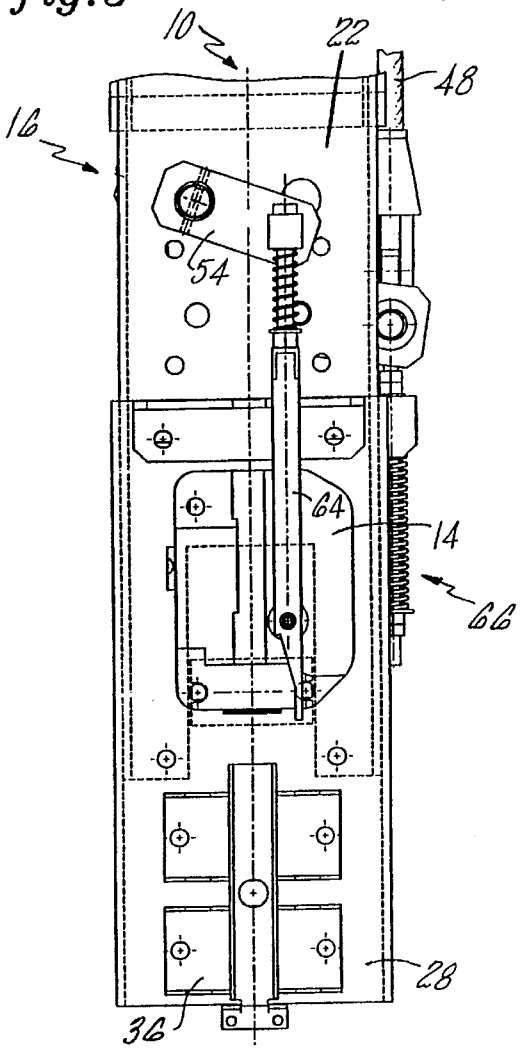
FIG. 5 is a side view of the safety brake apparatus on a second frame member.

Referring to FIGS. 4 and 5, to accomplish this goal, the safety brake apparatus 16 is arranged in the following manner: the pivot point 60 of the first link 52 is closer to the end connected to the pigtail 48 than the end attached to the intermediate link 58 as is shown in FIG. 4; and the pivot point 56 of each second link 54 is closer to the end of the second link 54 connected to the intermediate link 58 than to the end connected to the actuating rod 64-of the respective safety brake 14. In both cases, the tangential distance traveled by end of the link furthest away from the pivot 60,56 is greater than the tangential distance traveled by the end of the link closest to the pivot.

Figure 6:
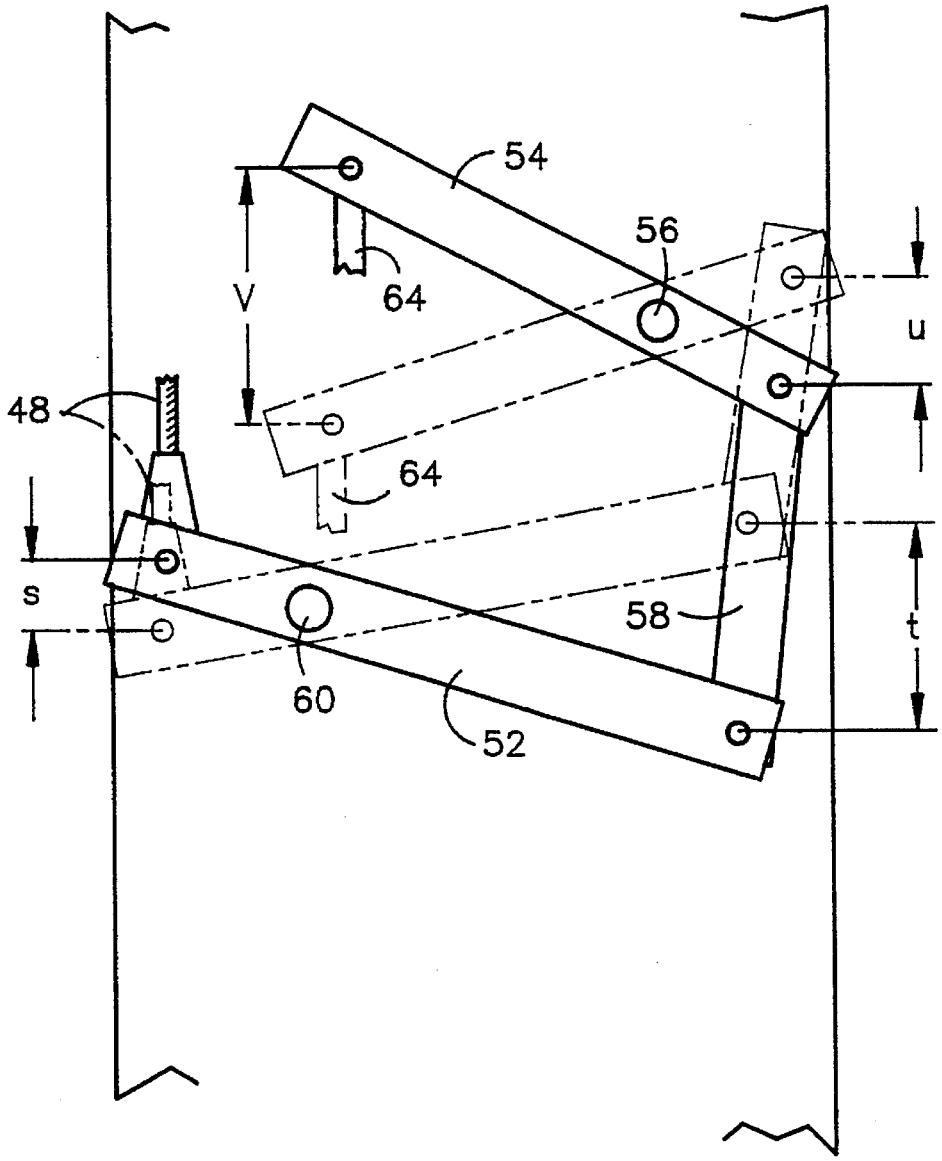
FIG. 6 is a diagrammatic view of the safety brake apparatus on the first frame member.

FIG. 6 diagrammatically shows the safety brake apparatus 16 on the first frame member side 20 of the counterweight 10. In terms of linear distance traveled, if the pigtail 48 moves relative to the counterweight 10 a distance "s", the end of the first link 52 and the attached intermediate link 58 will travel a distance "t", where "t" is greater than "s" by a ratio of the distances of the respective ends from the pivot point 60. Similarly, if the end of the second link 54 where the intermediate link 58 is attached moves a distance "u", then the opposite end of the second link 54 where the actuating rod 64 is attached will move a distance "v", where "v" is greater than "u" by the ratio of the distances of the respective ends from the pivot point; i.e., the connector rod 56. Hence, the linear motion of the "shorter" ends of the links 52,54 is amplified. A person of skill in the an will note that the motion of the links 52,56 pivoting is not strictly "linear", but may be described in terms of linear displacement from a starting point to a finishing point.

Amplifying the motion of the pigtail 48 relative to the counterweight 10 twice, as is described above, causes the safety brakes 14 to be actuated faster since less pigtail movement is required to actuate the safety brakes 14 and the pigtail 48 moves as a function of time. A person of skill in the art will recognize that the mechanical advantage described above may be adjusted by selectively positioning the pivots 60,56 of the first link 52 and/or the second link 54.

Referring to FIGS. 2–5, another advantage of the present invention is the ease at which the safety brakes 14 can be removed from the counterweight 10. A person of skill in the art will recognize that heretofore safety brakes 14 have been attached directly to the frame member 20,22 of the counterweight 10 and that tongues (not shown) extend out from the back of the safety brake 14 and into slots (not shown) within the counterweight frame member 20,22. The tongues make it impossible to remove the safety brake 14 while the counterweight is positioned between the guiderails 38. It has been necessary, therefore, to remove of one of the guiderails 38 before the safety brake 14 and/or the counterweight 10 can be removed.

In the present invention, a safety brake 14 can be removed simply by disconnecting it from the safety brake apparatus 16 and removing the frame extension 28 on that side of the counterweight 10. The frame extension 28 is removed by first removing the conventional fasteners (not shown) used to secure the extension 28 to the frame member 20,22 and then sliding the extension 28 down away from the frame member 20,22 until the extension 28 can be pulled away from the frame member 20,22.

The safety brake apparatus 16 has been described heretofore as being mounted on a counterweight 10. The safety brake apparatus 16 is equally applicable to elevator cars, and therefore may be properly described as a safety brake apparatus 16 for an elevator vehicle. Moreover, frame extensions 28 mounted on an elevator car can also be used to facilitate safety brake 14 removal.

Although this invention has been shown and described with respect to the detailed embodiments thereof, it will be understood by those skilled in the art that various changes in form and detail thereof may be made without departing from the spirit and scope of the claimed invention.

We claim:

1. A safety brake apparatus for a vehicle traveling in an elevator hoistway, comprising:

a first link, pivotly attached to a first side of said vehicle, a connector rod, extending through said first side and a second side of said vehicle, and pivotly mounted in said sides;

a pair of second links, one of said second links fixed to said connector rod on said first side of said vehicle and the other of said second links fixed to said connector rod on said second side of said vehicle, wherein each said second link is connected to an actuating rod of a safety brake on the respective side of said vehicle;

an intermediate link for connecting said first and second links on said first side of said vehicle;

wherein actuating said first link causes said intermediate link to rotate said connector rod and second links, said second links in turn causing said safety brakes to actuate, and thereby causing said safety brakes to brake said vehicle.

2. A safety apparatus according to claim 1, wherein said first link is connected to a governor rope of a governor rope assembly, said governor rope assembly including a brake for braking said governor rope in an overspeed condition;

wherein said governor rope is driven within said hoistway by said vehicle.

3. A safety apparatus according to claim 2, wherein a pivot mounting said first link to said first side is positioned such that moving said governor rope a particular distance relative to said vehicle causes said intermediate link connected to said first link to travel a greater distance, thereby amplifying motion of said governor rope, and therefore also said actuating rods.

4. A safety apparatus according to claim 3, wherein said connecting rod mounting said second links to said vehicle is positioned relative to said second links such that moving said intermediate link a particular distance causes said actuating rods attached to said second links, to travel a greater distance, thereby amplifying motion of said intermediate link.

5. A safety apparatus according to claim 4, further comprising:

an inertia compensator, said compensator mounted on said vehicle and connected to said first link;

wherein inertia of said governor rope assembly resists acceleration of said vehicle, and said inertia compensator dissipates said inertia and thereby prevents said safety brake from actuating in response to said inertia of said governor rope assembly.

6. A safety apparatus according to claim 5, wherein said inertia compensator comprises:

a spring;

a rod, having an end attached to said first link, said rod received within said spring; and a flange, attached to said first side of said vehicle, said flange having a hole for receiving said rod;

wherein said spring acts between said flange and a fastener attached to said rod, and thereby resists actuation of said first link and therefore actuation of said safety brakes.

7. A safety apparatus according to claim 6, wherein a pivot mounting said first link to said first side is positioned such that moving said governor rope a particular distance relative to said vehicle causes said intermediate link connected to said first link to travel a greater distance, thereby amplifying motion of said governor rope, and therefore also said actuating rods.

8. A safety apparatus according to claim 7, wherein said connecting rod mounting said second links to said vehicle is positioned relative to said second links such that moving said intermediate link a particular distance causes said actuating rods attached to said second links, to travel a greater distance, thereby amplifying motion of said intermediate link.

9. An elevator, comprising:

a hoistway;

a vehicle, for travel within said hoistway;

a governor rope assembly, having an overspeed brake and a governor rope extending throughout said hoistway;

a pair of safety brakes, each having an actuator arm for actuating said brake on one of said guiderails, wherein one of said brakes is attached to a first side of said vehicle and the other of said brakes is attached to a second side of said vehicle, said first and second sides being opposite one another; and a safety apparatus, comprising:

a first link, pivotly attached to said first side of said vehicle, said first link also attached to said governor rope;

a connector rod, extending through said first side and a second side of said vehicle, and pivotly mounted in said sides;

a pair of second links, one of said second links fixed to said connector rod on said first side and the other of said second links fixed to said connector rod on said second side, wherein each said second link is attached to said actuator arm of said safety brake on the respective side of said vehicle;

an intermediate link for connecting said first and second links on said first side of said vehicle;

wherein in an overspeed condition, said overspeed brake brakes said governor rope and thereby causes said governor rope to actuate said first link, said intermediate link, and said second links, said second links in turn actuating said safety brakes, thereby causing said safety brakes to brake said vehicle.

10. An elevator according to claim 9, wherein a pivot mounting said first link to said first side is positioned such that moving said governor rope a particular distance relative to said vehicle causes said intermediate link connected to said first link to travel a greater distance, thereby amplifying motion of said governor rope, and therefore also said actuating rods.

11. An elevator according to claim 10, wherein said connecting rod mounting said second links to said vehicle is positioned relative to said second links such that moving said intermediate link a particular distance causes said actuating rods attached to said second links, to travel a greater distance, thereby amplifying motion of said intermediate link.

12. An elevator according to claim 9, further comprising:

an inertia compensator, said compensator mounted on said vehicle and connected to said first link;

wherein inertia of said governor rope assembly resists acceleration of said vehicle, and said inertia compensator dissipates said inertia and thereby prevents said safety brake from actuating in response to said inertia of said governor rope assembly.

13. An elevator according to claim 12, wherein said inertia compensator comprises:

a spring;

a rod, having an end attached to said first link, said rod received within said spring; and a flange, attached to said first side of said vehicle, said flange having a hole for receiving said rod;

wherein said spring acts between said flange and a fastener attached to said rod, and thereby resists actuation of said first link and therefore actuation of said safety brakes.

14. An elevator according to claim 13, wherein a pivot mounting said first link to said first side is positioned such that moving said governor rope a particular distance relative to said vehicle causes said intermediate link connected to said first link to travel a greater distance, thereby amplifying motion of said governor rope, and therefore also said actuating rods.

15. An elevator according to claim 14, wherein said connecting rod mounting said second links to said vehicle is positioned relative to said second links such that moving said intermediate link a particular distance causes said actuating rods attached to said second links, to travel a greater distance, thereby amplifying motion of said intermediate link.

16. A counterweight for travel in a hoistway, comprising:

a frame, having a first side and a second side opposite one another;

a pair of frame extensions, one of which is removably attached to said first side and the other removably attached to said second side;

a pair of safety brakes fixed to the frame extensions, one on each side, each of said safety brakes having an actuator rod; and a linkage for operating said safety brakes, said linkage comprising:

a first link, pivotly attached to said first side;

a connector rod, extending through said first and second sides, and pivotly mounted therein;

a pair of second links, one of said second links fixed to said connector rod on said first side and the other of said second links fixed to said connector rod on said second side, wherein each said second link is connected to said actuating rod of said safety brake on that respective side of said frame;

an intermediate link for connecting said first and second links on said first side of said counterweight;

wherein actuating said first link causes said intermediate link to rotate said connector rod and second links, said second links in turn actuating said safety brakes, thereby causing said safety brakes to brake said counterweight.

17. A counterweight according to claim 16, wherein said first link is connected to a governor rope of a governor rope assembly, said governor rope assembly including a brake for braking said governor rope in an overspeed condition;

wherein said governor rope is driven within said hoistway by said counterweight.

18. A counterweight according to claim 17, wherein a pivot mounting said first link to said first side is positioned such that moving said governor rope attached to an end of said first link a particular distance relative to said counterweight causes said intermediate link connected to said first link to travel a greater distance, thereby amplifying motion of said governor rope, and therefore also said actuating rods.

19. A counterweight according to claim 18, wherein said connecting rod mounting said second links to said vehicle is positioned relative to said second links such that moving said intermediate link a particular distance causes said actuating rods attached to said second links, to travel a greater distance, thereby amplifying motion of said intermediate link.

20. A counterweight according to claim 17, further comprising:

an inertia compensator, said compensator mounted on said counterweight and connected to said first link;

wherein inertia of said governor rope assembly resists acceleration of said counterweight, and said inertia compensator dissipates said inertia and thereby prevents said safety brake from actuating in response to said inertia of said governor rope assembly.

21. A counterweight according to claim 20, wherein said inertia compensator comprises:

a spring;

a rod, having an end attached to said first link, said rod received within said spring; and a flange, attached to said first side of said vehicle, said flange having a hole for receiving said rod;

wherein said spring acts between said flange and a fastener attached to said rod, and thereby resists actuation of said first link and therefore actuation of said safety brakes.

22. A counterweight according to claim 21, wherein a pivot mounting said first link to said first side is positioned such that moving said governor rope a particular distance relative to said counterweight causes said intermediate link connected to said first link to travel a greater distance, thereby amplifying motion of said governor rope, and therefore also said actuating rods.

23. A counterweight according to claim 22, wherein said connecting rod mounting said second links to said vehicle is positioned relative to said second links such that moving said intermediate link a particular distance causes said actuating rods attached to said second links, to travel a greater distance, thereby amplifying motion of said intermediate link.

* * * * *